United States Patent [19]

Aubert

[11] Patent Number: 4,704,749

[45] Date of Patent: Nov. 10, 1987

[54] BODY LIFT AND WALKER FOR PARALYTICS

[76] Inventor: Benjamin A. Aubert, 4209 Bryce Dr., Anacortes, Wash. 98221

[21] Appl. No.: 866,535

[22] Filed: May 23, 1986

[51] Int. Cl.[4] ..... A61G 7/08

[52] U.S. Cl. ..... 5/81 B; 5/81 R; 5/83

[58] Field of Search ..... 5/81 B, 81 R, 86, 83, 5/89

[56] References Cited

U.S. PATENT DOCUMENTS

| | | | |
|---|---|---|---|
| 503,105 | 8/1893 | Tingley | 5/81 R |
| 1,061,715 | 5/1913 | Allen | 5/86 |
| 3,189,345 | 6/1965 | Simpson | 5/81 R |
| 3,203,009 | 8/1965 | Lundberg | 5/81 R |
| 3,277,502 | 10/1966 | Wauthier | 5/81 R |
| 3,374,493 | 3/1968 | Herrera | 5/81 R |
| 3,469,269 | 9/1969 | Brown | 5/86 |
| 3,623,169 | 11/1971 | James | 5/81 R |
| 3,629,880 | 12/1971 | van Rhyn | 5/86 |
| 3,694,829 | 10/1972 | Bakker | 5/81 R |
| 3,996,632 | 12/1976 | Bakker nee Viel | 5/86 |
| 4,409,696 | 10/1983 | Bakker | 5/81 B |
| 4,443,902 | 4/1984 | Baer | 5/81 B |
| 4,484,366 | 11/1984 | Koontz | 5/81 R |
| 4,510,633 | 4/1985 | Thorne | 5/81 R |
| 4,530,122 | 7/1985 | Sanders et al. | 5/81 R |

FOREIGN PATENT DOCUMENTS

| | | | |
|---|---|---|---|
| 1910836 | 10/1969 | Fed. Rep. of Germany | 5/83 |
| 2915715 | 10/1980 | Fed. Rep. of Germany | 5/81 R |
| 2414909 | 9/1979 | France | 5/81 R |
| WO84/02074 | 6/1984 | PCT Int'l Appl. | 5/81 R |
| 1078758 | 8/1967 | United Kingdom | 5/81 R |

*Primary Examiner*—Gary L. Smith
*Assistant Examiner*—Carl M. DeFranco, Jr.
*Attorney, Agent, or Firm*—Birch, Stewart, Kolasch & Birch

[57] ABSTRACT

A body lift (10) has a wheeled frame (12) and drive motor (42, 44) for moving the frame (12) on its wheels (48, 54). A vertical support (14) extends upward from a base (32) of the wheeled frame (12). Arm and leg support pairs (56, 58 and 78, 80) are movably mounted for translation along the vertical support (14). An elevation motor (28) is connected to lead screw (16) to move the arm and leg support pairs (56, 58 and 78, 80) along the vertical support (14). The leg supports (78, 80) of the leg support pair are laterally pivotable toward and away from each other. A torsion spring (102) is connected to urge the leg supports (78, 80) to a normally outwardly pivoted position. The arm supports (56, 58) of the arm support pair are coupled to pivot the leg supports (78, 80) inward laterally in response to weight applied by a user to the arm supports (56, 58). A control (57) engageable by the user (100) is connected to the motors (28, 42 and 44) to allow the user to move the lift (10) on its wheels (46, 48) and casters (52, 54) and to adjust the height of the arm and leg support pairs (56, 58 and 78, 80).

9 Claims, 11 Drawing Figures

BODY LIFT AND WALKER FOR PARALYTICS

ORIGIN OF THE INVENTION

The invention described herein was made by an employee of the U.S. Government and may be manufactured and used by or for the Government for governmental purposes without the payment of any royalties thereon or therefor.

BACKGROUND OF THE INVENTION

1. Field of the Invention

This invention pertains to a novel device for lifting a seated incapacitated person, such as a paralytic. More particularly, it relates to such a device which provides lifting support at the user's armpits and legs in a novel manner that permits many disabled persons to use the device without assistance.

2. Description of the Prior Art

A variety of lifting and supporting devices for disabled persons are known in the art. For example, such devices are shown in the following issued U.S. Pat. Nos. 503,105, issued Aug. 8, 1893 to Tingley; 3,374,493, issued Mar. 26, 1968 to Herrera; 3,623,169, issued Nov. 30, 1971 to James; 3,996,632, issued Dec. 14, 1976 to Bakker nee Viel; 4,530,122, issued July 23, 1985 to Sanders et al. While many of the devices known in the art provide supports for engaging both the legs and armpits or upper torso in order to provide safe and comfortable lifting, these prior art devices also require the presence of another person, usually a nurse or paramedic, to position the devices properly and place the supports about the disabled person's body. Such a limitation has not prevented the prior art devices from achieving widespread usage in hospitals, convalescent homes and other health care facilities where trained personnel are available to use the devices. However, this restriction imposed by prior art equipment has meant that disabled persons who might otherwise be able to function outside an institutional environment must live in facilities where such help is present, unless family members are able to provide such help or the disabled individual is wealthy enough to be able to hire such help. Even in such instances, however, the temporary unavailability of assistance results in substantial inconvenience and even discomfort for disabled people. The current trend toward making buildings, sidewalks and vehicles that do not present barriers for the disabled allows many more disabled persons to live and work effectively in society outside of special institutions equipped to provide care for these persons. Additional improvements which increase the independence of the disabled will allow even more disabled persons to lead a more normal life, and allow those disabled persons who already live independently to have a more pleasant and productive life.

SUMMARY OF THE INVENTION

Accordingly, it is an object of this invention to provide a lifting device for paralytics that can be positioned and used by a disabled person without assistance.

It is another object of the invention to provide such a lifting device which will engage a user's legs when the user is seated in response to weight applied by the user on supports for engaging the user's arms.

It is a further object of the invention to provide such a lifting device which the user can employ without assistance for both lifting from a seated position and moving to another location.

It is still another object of the invention to provide such a lifting device which will also function as a walker for the disabled person.

The attainment of these and related objects may be achieved through use of the novel body lift for paralytics herein disclosed. A body lift in accordance with this invention has a wheeled frame and a first drive means for moving the frame on its wheels. A vertical support extends upward from a base of the wheeled frame. Arm and leg support pairs are movably mounted for translation along the vertical support. A second drive means is connected to move the arm and leg support pairs along the vertical support. The leg supports of the leg support pair are laterally pivotable toward and away from each other. A biasing means is connected to urge the leg supports to a normally outwardly pivoted position. The arm supports of the arm support pair are coupled to pivot the leg supports inward laterally in a substantially orthogonal direction relative to said arm supports in response to weight applied by a user to the arm supports. A control engagable by the user is connected to the first and second drive means to allow the user to move the device on its wheels and to adjust the height of the arm and leg support pairs.

In use, the user employs the control to position the lift so that the arm support pair is beneath the user's armpits when the user is in a seated position facing the lift, with the leg supports on either side of the user's legs in their outward pivoted position. The user then leans onto the arm supports, applying weight to them. In response, the arm supports supply force to pivot the leg supports inward, beneath the user's legs. The user may then use the control to raise the arm and leg supports for lifting the user. Further use of the control then allows the user to move to another location while being carried by the body lift, then to lower the arm and leg supports so that the user is placed in the new location in a seated position. The lift may also be used as a walker by operating its control to raise the arm supports sufficiently to straighten out the user's legs, and operating the control to move the lift about.

The attainment of the foregoing and related objects, advantages and features of the invention should be more readily apparent to those skilled in the art, after review of the following more detailed description of the invention, taken together with the drawings, in which:

1 and 2 in different positions during operation of the body lift.

Figure 7:
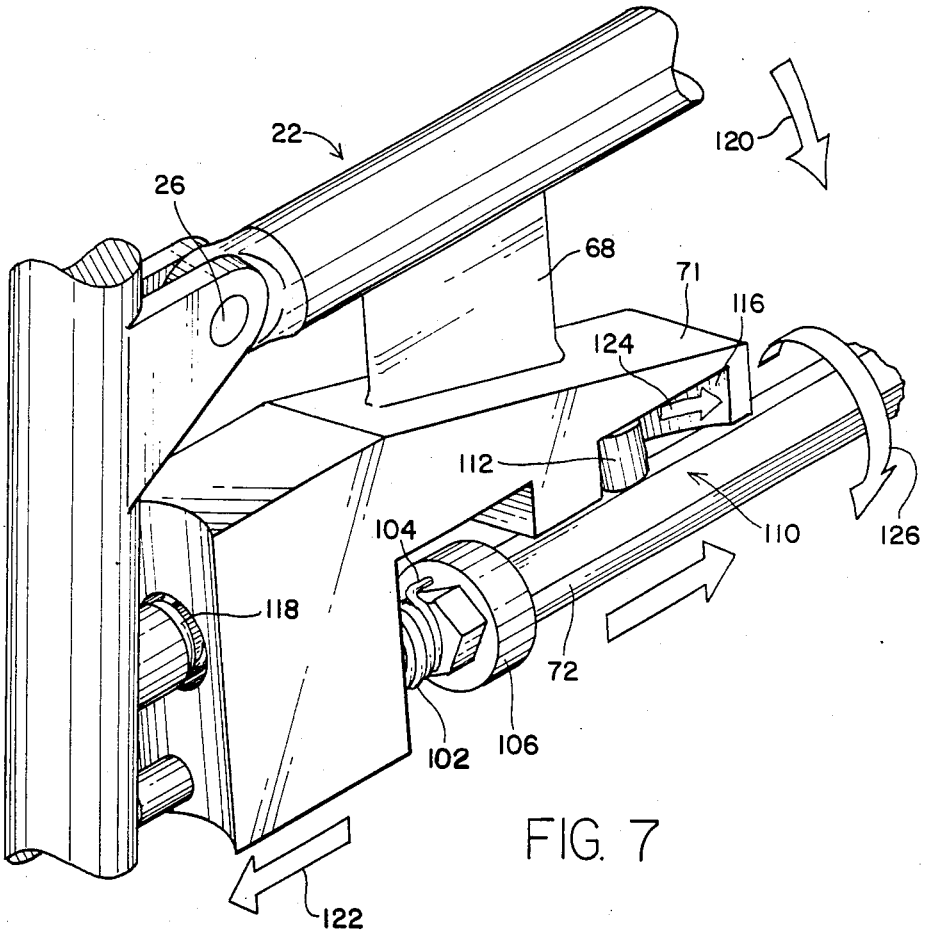
FIG. 7 is an enlarged cross section view of a portion of the body lift shown in FIGS. 1 and 2.
Figure 8A:
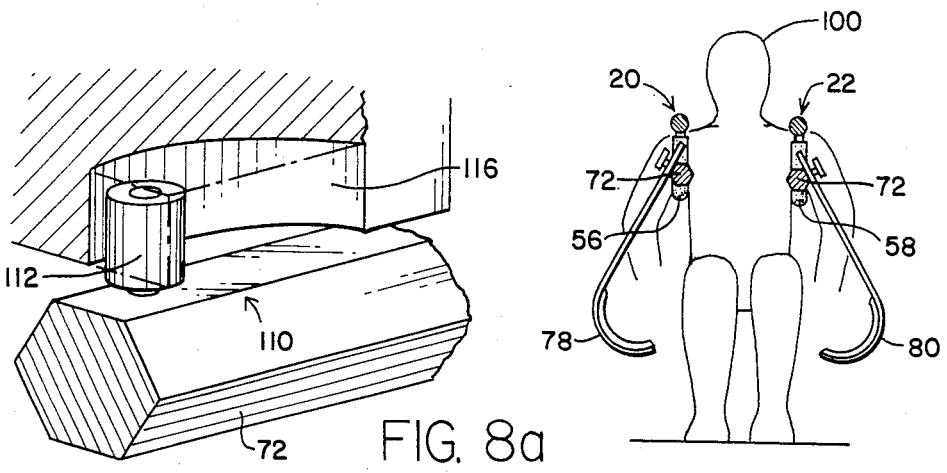
FIGS. 8*a*, 8*b* and 8*c* are sequential perspective and front views of portions of the body lift shown in FIGS.
Figure 8B:
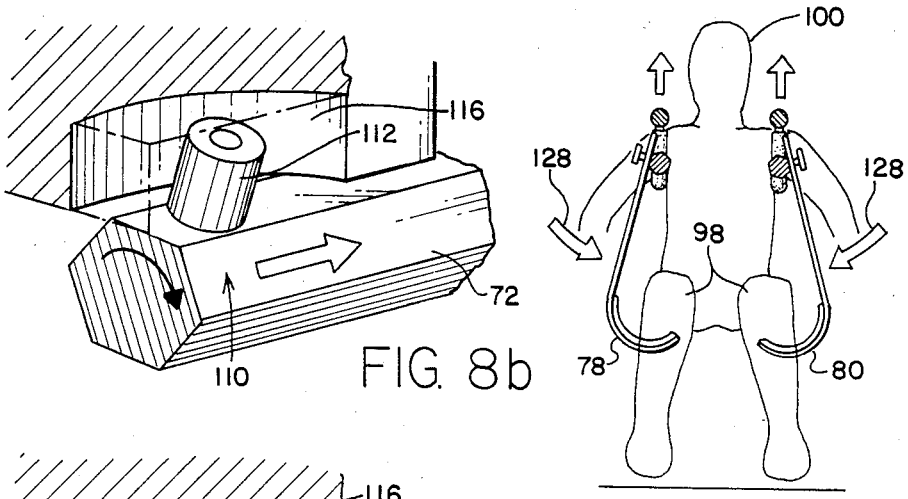
Figure 8C:
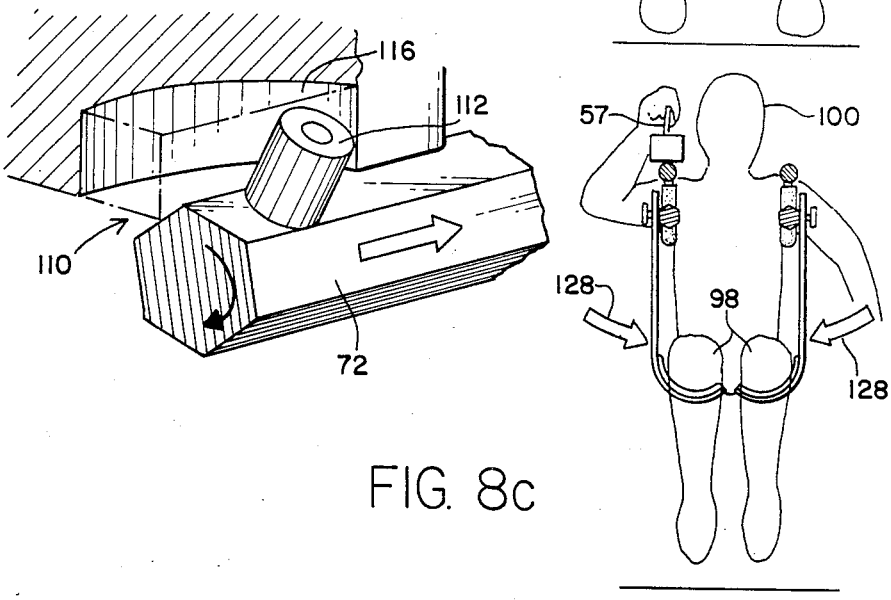
Figure 9:
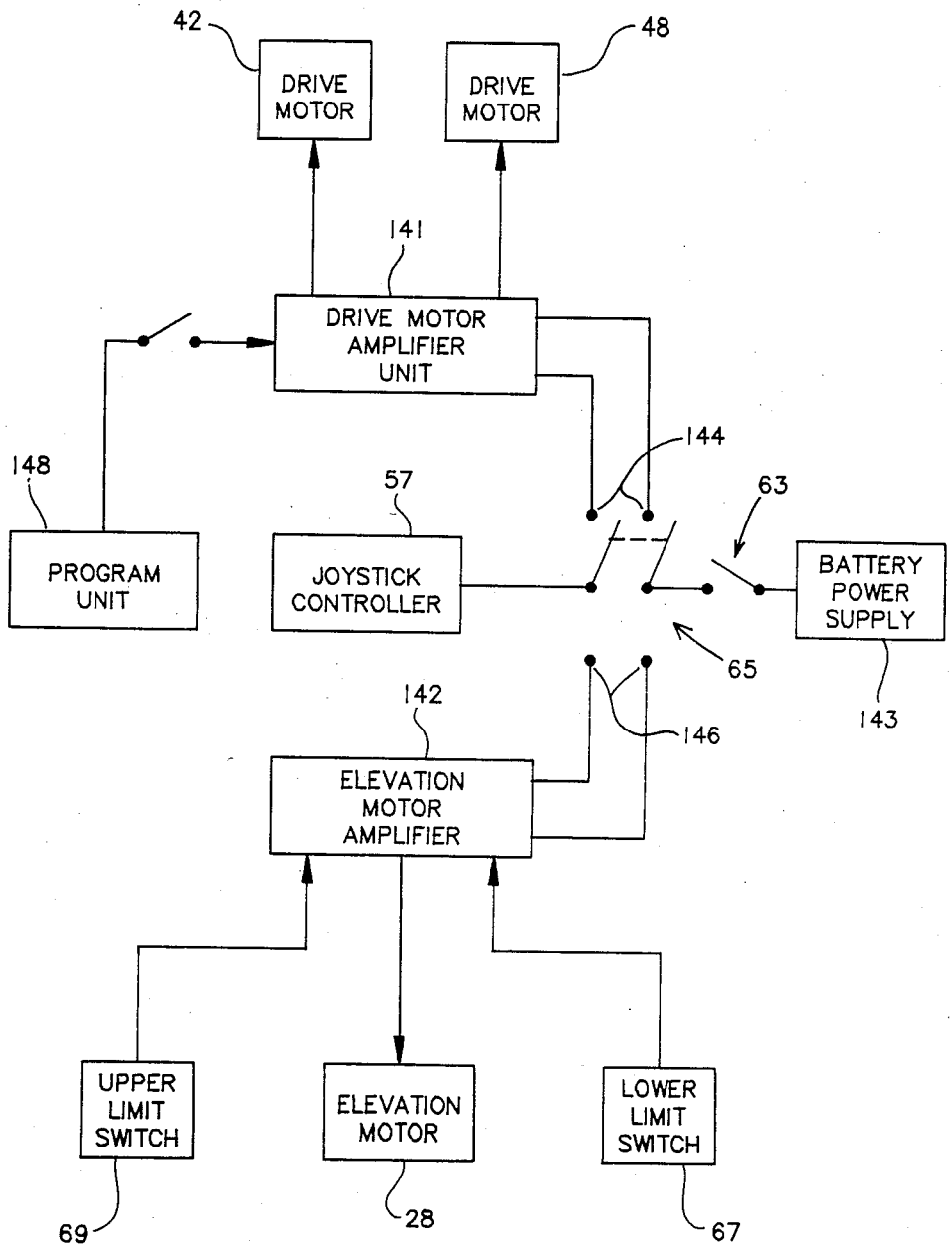

FIG. 9 is a block and schematic circuit diagram of a control system for use in the body lift of FIGS. 1–8c.

DETAILED DESCRIPTION OF THE INVENTION

Figure 1:
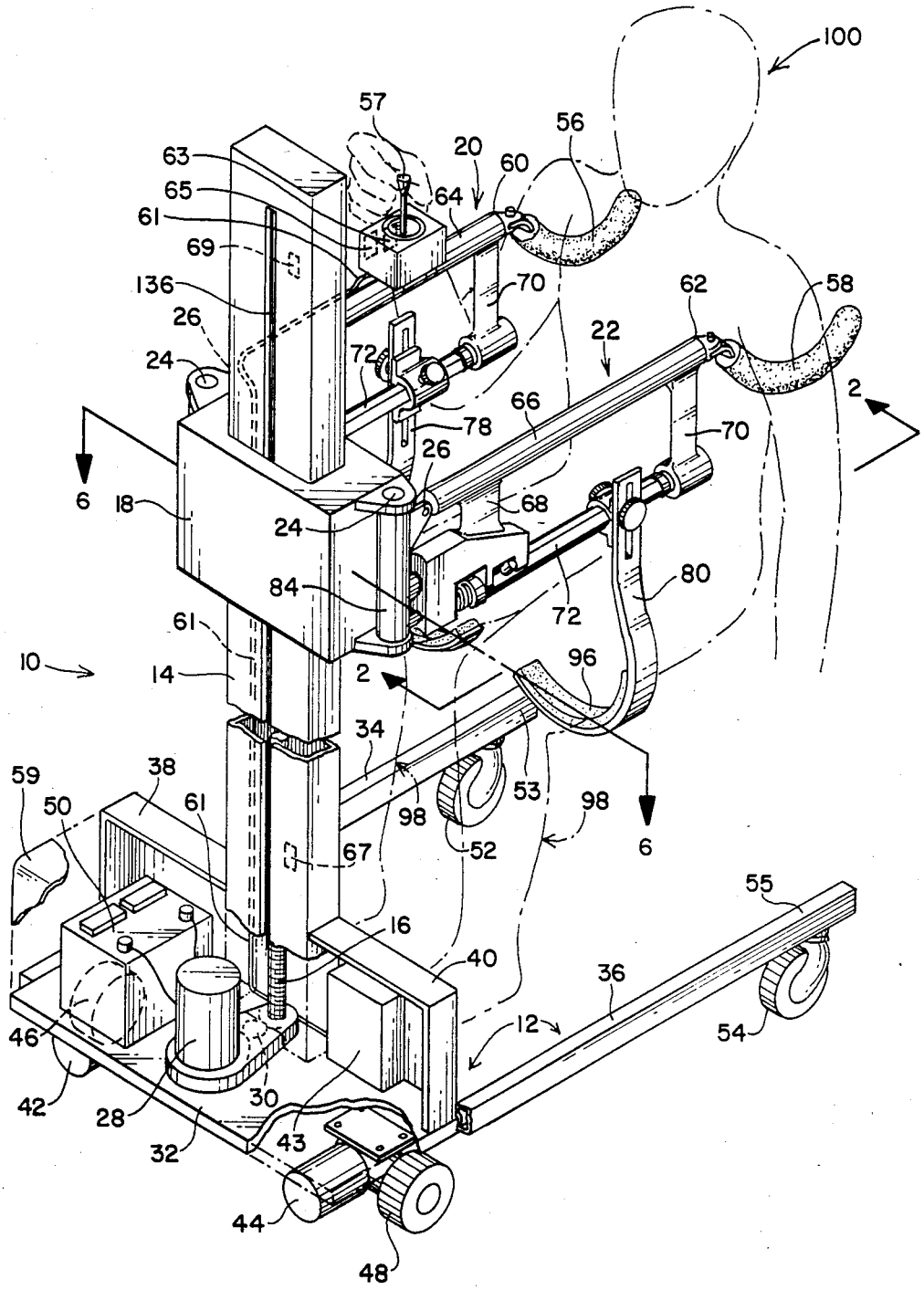
FIG. 1 is a perspective view of a body lift in accordance with the invention.

Turning now to the drawings, more particularly to FIG. 1, there is shown a body lift 10 in accordance with the invention. The body lift 10 has a frame 12 with a vertically extending support 14. A lead screw 16 extends along the support 14. Carriage 18 is movably mounted on the vertical support 14 and is threaded to the lead screw 16. Lift arms 20 and 22 are pivotally attached to the carriage at 24 and 26, so that the arms 20 and 22 will pivot both horizontally and vertically with respect to the carriage 18. An elevation motor 28 is connected by gears 30 to rotate the lead screw 16 for translating the carriage 18 along the vertical support 14. The elevation motor 28 may be implemented, for example, with a permanent magnet DC motor which will generate ¼ horsepower at 24 volts. Such a motor is commercially available from Dayton Electric Mfg. Co., Chicago, Ill. 60648 under the designation 4Z143. Vertical support 14 and drive motor 28 are mounted on base 32. Horizontal frame members 34 and 36 are welded to the base 32. The frame members 34 and 36 are spaced apart sufficiently so that a wheelchair will fit between them. Drive motors 42 and 44 are connected to drive wheels 46 and 48, which are rotatably mounted on the base 32. The drive motors 42 and 44 may be implemented, for example, with type PM 24 volt DC, class F electric motors. A standard 12 volt automobile battery 50 is mounted on the base 12 to the left of drive motor 28, connected to provide power for the drive motors 28, 42 and 44. A second battery (not shown) is mounted to the right of the drive motor 28 and is serially connected to the battery 50 in order to provide 24 volts DC to the drive motors 28, 42 and 44. Casters 52 and 54 are provided at ends 53 and 55 of the frame members 34 and 36. A manually engageable two-axis joystick control 57 is mounted on the left arm 20 of the lift 10 by means of a detachable clamp (not shown). For left handed persons, the joystick control can be mounted on the right arm 22. The joystick control 57 can be of the type employed on Everest-Jennings wheelchairs, obtainable from Everest-Jennings, Los Angeles, Calif. 90025, or another commercially available joystick control, available from a number of suppliers. The joystick control is electrically connected to the batteries and motor power amplifiers, contained in housing 43, by cable 61. A switch 63 serves as the On/Off switch for the battery power supply. The switch 63 switches the control 57 between the elevation motor 28 and the drive motors 42 and 44 for controlling vertical movement of the carriage 18 and movement of the lift 10 on wheels 46, 48 and casters 52, 54. A plastic cover comprising portions 38, 40 and 59 enshrouds the batteries and other components on base 32.

Figure 2:
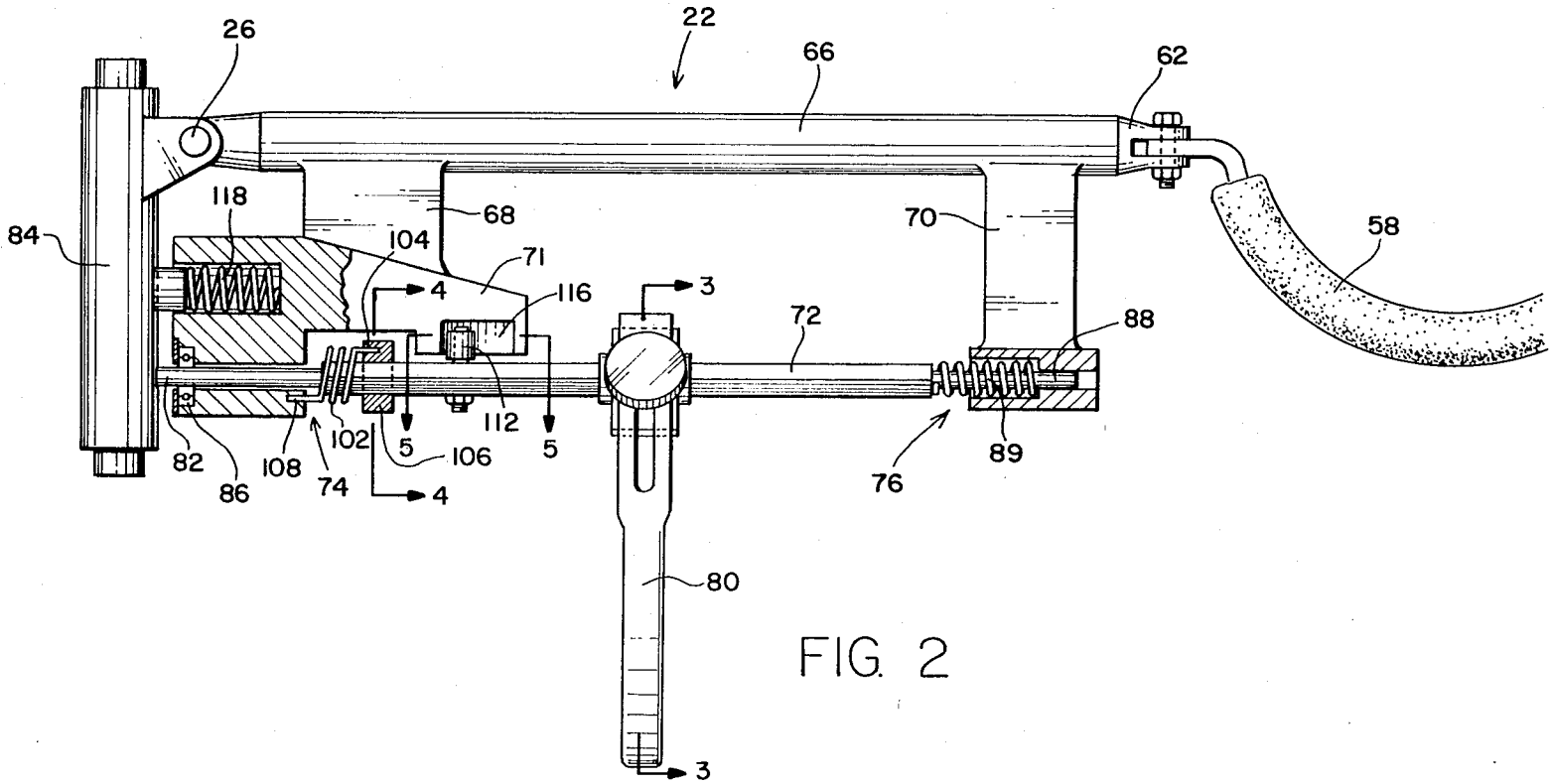
FIG. 2 is a side view of a portion of the body lift shown in FIG. 1, from the position indicated by the line 2—2 in FIG. 1.

Further details of the arms 20 and 22 are shown in FIGS. 1 and 2. Since the left arm 20 contains corresponding parts, most of the following description will be with respect to the right arm 22. Padded armpit supports 56 and 58 are bolted to ends 60 and 62 of rods 64 and 66. Brackets 68 and 70 extend from each of the rods 64 and 66. A bracket block 71 is attached to the bracket 68. Leg support rod 72 is rotatably attached to the bracket block 71 and bracket 70 at 74 and 76. Leg supports 78 and 80 are clamped to the left and right support rods 72, respectively. The leg support rod 72 is fixedly attached to push rod 82, which passes through the bracket block 71 to engage arm cylinder 84, and is rotatably attached by bearing 86 to the bracket block 71. Rod 88 at the other end of the leg support 72 is rotatably attached to the bracket 70. Spring 89 pushes against the leg support rod 72 to bias the push rod 82 against the arm support 84.

Figure 3:
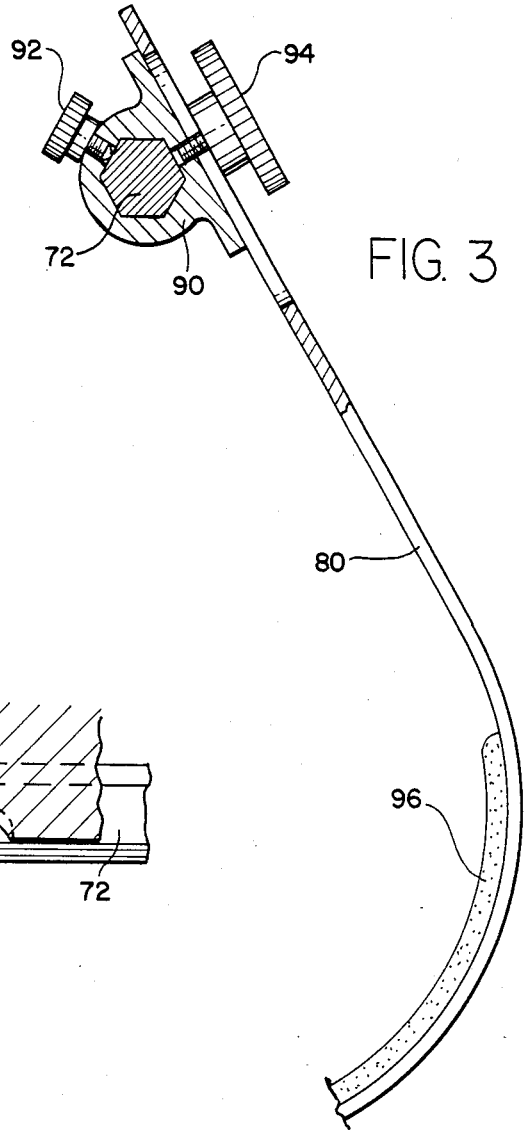
FIG. 3 is a cross section view, taken along the line 3—3 in FIG. 2.

As is best shown in FIG. 3, leg support 80 is attached to the leg support rod 72 by bracket 90 and knobs 92 and 94, which allow the bracket 90 to be loosened, so that the leg support 80 can be moved along the leg support rod 72 for different size individuals with which the body lift 10 is to be used. The hexagonal cross section of the leg support rod 72 assures that the bracket 90 will fasten the leg support 80 securely in place. The position of the leg supports 78 and 80 should be adjusted along the leg support rods 72 so that the leg supports 78 and 80 pass beneath legs 98 of the user 100 slightly above the knee. The leg support 80 is padded at 96 for comfort during lifting.

Figure 4:
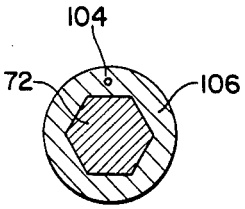
FIG. 4 is a second cross section view, taken along the line 4—4 in FIG. 2.
Figure 5:
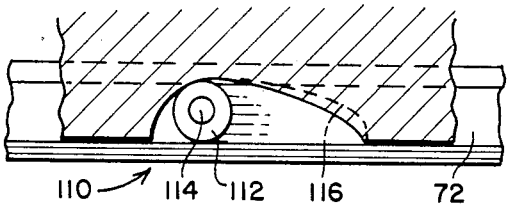
FIG. 5 is a third cross section view, taken along the line 5—5 in FIG. 2.

As is shown in FIGS. 2, 4 and 7, a torsion spring 102 has a first end 104 fixedly attached to the leg support rod 72 by collar 106, and a second end 108 fixedly attached to the bracket 68. Torsion spring 102 biases the leg support rod 72 so that it is normally rotated to position the leg support 80 so that it is pivoted outward, as shown in FIG. 3 and FIG. 8a. A corresponding spring biases the left leg support 78 to a corresponding outward pivoted position.

FIGS. 2, 5, 7 and 8a–8c show details of camming mechanism 110. A cam roller 112 is rotatably mounted by means of shaft 114 to the leg support rod 72. An arcuate cam surface 116 formed on the bracket block 71 engages the cam roller 112. A spring 118 in the bracket block 71, in cooperation with the torsion spring 102, biases the bracket block 71 and the cam roller 112 to the position shown in FIGS. 2, 5, 7 and 8a.

In operation, when the user 100 applies downward force on the arm support 58, the arm 22 pivots at 26, as indicated by arrow 120, moving the bracket block 71 toward the arm cylinder 84, as indicated by arrow 122. However, push rod 82 engaging the arm cylinder 84 prevents the leg support rod 72 from moving in a similar manner. As a result, the cam roller 112 moves along the cam surface 116, as indicated by arrow 124, providing a rotating force on leg support rod 72, as indicated by arrow 126. FIGS. 8a, 8b and 8c show how this rotation of the leg support rod 72 as the cam roller 112 moves along the cam surface 116 pivots the leg supports 78 and 80 beneath the legs 98 of the user 100, as indicated by arrows 128 in FIGS. 8b and 8c.

In use, the user 100 uses the control 57 to position the lift 10 with the frame members 34 and 36 on either side of the user's legs 98 and armpit supports 56 and 58 beneath the user's armpits. The user then leans on the supports 56 and 58 to pivot the leg supports 78 and 80 beneath the user's legs 98 in the manner described above. When the leg supports 78 and 80 are fully pivoted to the position shown in FIG. 8c, the user 100 then uses the control 57 to lift the user from a surface on which the user 100 is seated, such as an edge of a bed or a wheelchair. The lift 10 may then be moved to a new location by operating the control 57, and the user lowered to a new supporting surface. When the user 100 removes weight from the armpit supports 56 and 58, springs 102 and 118 cause the cam roller to reverse the motion shown in FIGS. 8a–8c, pivoting the leg supports 78 and 80 back to the position shown in FIG. 8A. The user 100 then may use the control 57 to move the lift 10 away. If the user 100 is unattended, the lift 10 will be kept close enough to the user 100 to allow the control 57 to be reached when the user 100 wishes to move again.

Figure 6:
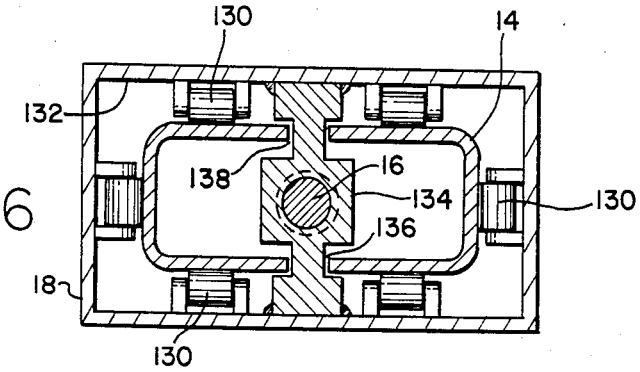
FIG. 6 is a fourth cross section view, taken along the line 6—6 in FIG. 1.

FIG. 6 shows details of the vertical support 14 and carriage 18. A plurality of rollers 130 are mounted on inside surface 132 of the carriage 18 and engage the vertical support 14. Bar 134 extends through slots 136 (see also FIG. 1) and 138, and is fixedly attached to the inside surface 132 of the carriage 18. Lead screw 16 is threaded to the bar 134. As the lead screw 16 is rotated by the drive motor 28, the bar 134 moves up and down along the lead screw 16.

FIG. 9 is a block schematic diagram depicting the electric circuit for controlling the drive motors 42, 48 and elevation motor 28, Switch 63 serves as the ON/-OFF switch for the battery power supply 143. Drive motor amplifier unit 141 comprises two power amplifiers, one for drive motor 42 and one for drive motor 48. The output of elevation motor power amplifier 142 is coupled to elevation motor 28. Switch 65 is a two-position switch and the switch may be installed in the stick of joystick control 57 or on the cabinet that houses joystick control 57. When the movable switch contacts of switch 65 engage terminals 144, electric current from power supply 143 is permitted to flow to amplifier unit 141 (if switch 63 is closed) and two-axis joystick control 57 is coupled to the inputs of the amplifiers in amplifier unit 141. When joystick 57 is moved from its neutral position, drive motors 42, 48 are energized. The direction of rotation of the motors and the speed of the motors is a function of the direction of displacement of the joystick and the amount of displacement from the neutral. The leads to the terminals of the joystick control are preferably arranged so that the body lift moves in the same direction that the joystick is pushed. When the movable contacts of switch 65 are thrown to terminals 146, the power is disconnected from the amplifier unit 141 and transferred to elevation motor amplifier 142. Further, joystick control 57 is disconnected from amplifier unit 141 and coupled to elevation motor amplifier 142. Only one axis of the control is utilized to provide an input signal for amplifier 142. When the joystick is displaced from its neutral position along the utilized axis, the elevation motor is energized and rotates lead screw 16. The direction of rotation of the lead screw is dependent on the direction of displacement of the joystick, and the speed of rotation of the lead screw in a function of the amount of displacement of the joystick from its neutral position. For purposes of safety, limit switches 67 and 69 are provided to stop the rotation of motor 28 when carriage 18 reaches predetermined lower and upper limits along lead screw 16. The limit switches may be configured to either short the input to amplifier 142 or open it when actuated. The joystick control 57 may be a two-axis, four-quadrant potentiometric analog control device such as the Type 02 manufactured by Bolt Industrial Controls, Inc., 4645-2F Industrial Street, Simi Valley, Calif. 93063. That control device is available with or without a pushbutton mounted on the top of the joystick. If desired, a dc tachometer may be mechanically coupled to each motor 28, 42 and 48, and the electrical output used as a conventional servo velocity feedback signal. Suitable power amplifiers for the motors are the HB Series MOSFET amplifiers manufactured by Motion Science Inc., 1485 Kerley Drive, San Jose, Calif. 95112. It is possible to reduce the number of power amplifiers in the circuit from three to two by slightly modifying switch 65 so that one power amplifier in unit 141 is either switched to a drive motor or to elevation motor 28. This would obviate the need for a separate, dedicated amplifier 142. It is preferable that the batteries for power supply 143 be rechargeable, maintenance free, leak proof, deep-cycle batteries that do not emit gases and require no addition of water. A suitable battery is the TS-310 or TS-60 Torque Starter®, manufactured by Chloride, Inc., Tampa, Fla. 33601.

It is to be understood that the body lift may be used for walking exercise. In such an exercise mode the user would not use leg supports 78 and 80, just armpit supports 56 and 58. Armpit supports 56 and 58 would be elevated so that they supported the user in an erect or nearly erect position and the user's feet touched the floor. The drive motors 42 and 48 would be energized and the user would walk along with the moving body lift. The user would either control the movement of the body lift by means of joystick control 57 or program unit 148. Program unit 148 may comprise a tape player, a microprocessor or any other conventional device capable of generating signals that will cause drive motors 42 and 48 to move the body lift along a predetermined path at a predetermined speed.

It should now be readily apparent to those skilled in the art that a novel body lift for paralytics capable of achieving the stated objects of the invention has been provided. The body lift of this invention can be used by many disabled persons both to lift the user from a seated position and move the user to a new location without assistance. By applying weight to the armpit supports of the lift, the user pivots the leg supports beneath the user's legs. The body lift of this invention should allow more disabled persons to function independently, or allow more severely disabled persons to live with family members who lack the strength to lift and move such disabled persons. If the armpit supports are raised high enough to straighten out the user's legs, the lift may also be used as a walker for enhancing mobility and exercising the user.

It should further be apparent to those skilled in the art that various changes in form and detail of the invention as shown and described may be made. It is intended that such changes be included within the spirit and scope of the claims appended hereto.

What is claimed is:

1. A body lift for a disabled person comprising:

a frame including a base and a plurality of wheels mounted on said base for permitting movement of said frame;

a first drive means mounted on said frame and operatively connected for imparting rotation to said wheels;

a vertical support extending upward from said base of said frame;

a pair of arm supports and a pair of leg supports movably mounted for translation along said vertical support; means for operatively connecting said leg supports to said arm support;

a second drive means mounted on said frame and connected to move said arm and leg support pairs along said vertical support;

said leg supports of said leg support pair being laterally pivotable toward and away from each other;

a biasing means connected to urge the leg supports to a normally outwardly pivoted position;

said arm supports of said arm support pair being coupled to pivot the leg supports inward laterally in a substantially orthogonal direction relative to said arm supports in response to weight applied by a user to the arm supports; and a control means connected to said first and second drive means for controlling movement of said frame on its wheels and for adjusting the height of said arm and leg support pairs.

2. The body lift of claim 1 in which said control means is positioned on said body lift to be engageable by the user.

3. The body lift of claim 1 in which the arm supports are coupled to pivot the leg supports inward laterally in response to weight applied by the user to the arm supports by a pair of rotatable rods with one of the leg supports on each rotatable rod, each of the arm supports being movable with respect to each rotatable rod, a camming surface and a means for following the camming surface between each arm support and each rotatable rod, said camming surface and means for following said camming surface being configured to convert movement between each rotatable rod and arm support to rotary motion of each rotatable rod.

4. The body lift of claim 3 in which said biasing means comprises a torsion spring connected to urge each rotatable rod to a rotated position in which the leg supports are in their outward pivoted position with respect to each other.

5. The body lift of claim 3 in which said camming surface is fixedly attached to each arm support and said means for following said camming surface comprises a cam roller rotatably mounted on each rotatable rod.

6. The body lift of claim 1 in which said second drive means comprises a lead screw extending along said vertical support and said pair of arm and leg supports are mounted on a carriage which is movably mounted for translation along said vertical support, said carriage being threaded to said lead screw.

7. The body lift of claim 1 in which said pair of arm supports each have a padded, arcuate armpit engaging member.

8. The body lift of claim 7 in which said pair of leg supports each have a padded, arcuate leg engaging member, the leg engaging members being positioned to engage the user's legs slightly above the knee when the user's armpits are engaged by the armpit engaging member.

9. The body lift of claim 1 in which said body lift is also usable as a walker for exercising a disabled user, said pair of arm supports being movable along said vertical support to a sufficient height for supporting the user in an erect position with the user's feet touching the ground.

* * * * *